United States Patent [19]

Houck, Jr. et al.

[11] Patent Number: 4,687,008

[45] Date of Patent: Aug. 18, 1987

[54] FILTER CIGARETTE

[75] Inventors: Willie G. Houck, Jr., Richmond; Francis M. Sprinkel, Jr., Glen Allen; Reginald W. Newsome, Richmond; David B. Spruill, Richmond; Walter A. Nichols, Richmond, all of Va.

[73] Assignee: Philip Morris Incorporated, New York, N.Y.

[21] Appl. No.: 853,049

[22] Filed: Apr. 17, 1986

[51] Int. Cl.[4] ..... A24D 3/04

[52] U.S. Cl. ..... 131/335; 131/336; 131/191; 131/192; 131/94; 131/361

[58] Field of Search ..... 131/335, 336, 191, 192, 131/94, 95, 361

[56] References Cited

U.S. PATENT DOCUMENTS

| | | | |
|---|---|---|---|
| 864,307 | 8/1907 | Jones . | |
| 2,206,165 | 7/1940 | Daymude . | |
| 2,223,302 | 11/1940 | Germain . | |
| 2,693,193 | 11/1954 | Pelletier . | |
| 2,705,013 | 3/1955 | Brothers . | |
| 2,820,462 | 1/1958 | Fleischer | 131/361 |
| 2,823,680 | 2/1958 | Busby . | |
| 2,923,647 | 2/1960 | Aghnides . | |
| 2,936,763 | 5/1960 | Saffir . | |
| 2,951,486 | 9/1960 | Walters . | |
| 3,065,756 | 11/1962 | Davies . | |
| 3,409,019 | 11/1968 | Chun . | |
| 3,486,508 | 12/1969 | Sipos . | |
| 3,503,406 | 3/1970 | Riegel et al. . | |
| 3,512,537 | 5/1970 | Pelletier . | |
| 3,858,587 | 1/1975 | Cavelli et al. . | |
| 4,526,183 | 7/1985 | Nichols et al. . | |

FOREIGN PATENT DOCUMENTS

| | | |
|---|---|---|
| 0105682 | 4/1984 | European Pat. Off. . |
| 0107507 | 5/1984 | European Pat. Off. . |
| 1409656 | 7/1965 | France . |
| 7900269 | 5/1979 | PCT Int'l Appl. . |
| 11989 | of 1904 | United Kingdom . |
| 256432 | 8/1926 | United Kingdom . |

*Primary Examiner*—V. Millin

*Attorney, Agent, or Firm*—Jeffrey H. Ingerman

[57] ABSTRACT

A cigarette is provided having a variable length. A filter or mouthpiece slides within a sleeve attached to the cigarette, or a sleeve attached to the filter or mouthpiece slides over the cigarette. A single band is adhered to one element and a pair of bands is adhered to the other element. The single band is captive between the pair of bands so that the cigarette can be lengthened or shortened within the range allowed by the pair of bands, but the filter or mouthpiece cannot be removed from the cigarette. The variable length mechanism can be made to additionally provide variable dilution or variable flavorant.

35 Claims, 7 Drawing Figures

10
11
12
13
14
15
16
17
18
19
21
22
23
70
71
80
81
101
100
111
112
113
116
118
121
122
2
2

FILTER CIGARETTE

BACKGROUND OF THE INVENTION

This invention relates to filter cigarettes. More particularly, this invention relates to a filter cigarette having an adjustable length.

Cigarettes are normally sold in 85 mm and 100 mm lengths. However, some smokers may prefer other lengths. One study, in fact, has shown that many smokers would prefer a cigarette having a length of 90 mm. It is likely that smokers actually have preferences for a range of lengths depending on individual taste. Some smokers may prefer different lengths in different circumstances.

It is well known that a cigarette can be smoked through a holder. A smoker desiring a different length cigarette can obtain a holder of the desired length with which to smoke cigarettes. However, it is not always convenient to have to carry a holder in addition to one's cigarettes, and a holder represents an additional expense. There is no cigarette available the length of which can be varied by means of integral elements that cannot be removed.

It is also desirable for the smoker to be able to vary some characteristics of a cigarette, such as its air dilution value and its flavor. It is known to provide cigarettes having integral rotatable elements which, when rotated, vary the registry of openings in the cigarette tipping paper and plug wrapping to vary air dilution, or which rupture capsules containing flavorant material, such as menthol or other materials. However these known cigarettes do not also provide for variable lengthening of the cigarette.

SUMMARY OF THE INVENTION

It is an object of this invention to provide a cigarette which can be lengthened by means of integral elements that are retained against removal from the cigarette. It is another object of the invention that these integral elements be able to function as a mouthpiece.

It is a further object of this invention that the extendable elements provide the smoker with the ability to control the smoking characteristics of the cigarette, including air dilution and flavor.

In accordance with this invention, there is provided a filter cigarette comprising a substantially cylindrical tobacco rod and a substantially cylindrical filter plug. The tobacco rod and filter plug have substantially the same cross-sectional area and shape. Tipping paper circumscribes the filter plug and a portion of the tobacco rod. A means is associated with the filter plug for lengthening and shortening the cigarette while retaining the filter plug against removal from the cigarette.

In one embodiment, the filter cigarette comprises a substantially cylindrical cigarette rod and a substantially cylindrical filter plug having a mouth end and a rod end open to the passage of air and smoke. The cigarette rod and the filter plug have substantially the same cross-sectional area and shape. A peripheral layer circumscribes the filter plug. A first section of tipping paper circumscribes the filter plug adjacent its mouth end. A second section of tipping paper circumscribes a portion of the filter plug adjacent is rod end and a portion of the cigarette rod adjacent the filter plug, and is adhered to the cigarette rod. First, second and third bands, in sequence, circumscribe the filter plug between the peripheral layer and the tipping paper. The first band is adhered to the peripheral layer at a first preselected distance from the rod end of the filter plug, and to the first section of tipping paper. The third band is adhered solely to the peripheral layer at a second preselected distance from the rod end of the filter plug. The first distance exceeds the second distance by at least the width of the second band. The second band is adhered solely to the second tipping paper section at a third preselected distance from the end of the cigarette rod adjacent the filter plug. The third preselected distance is at least equal to the first preselected distance. The filter plug is thereby movable longitudinally between a position in which the second band abuts the third band and a position in which the second band abuts the first band, lengthening or shortening the cigarette.

In a second embodiment, the filter cigarette comprises a substantially cylindrical cigarette rod and a substantially cylindrical filter plug having a mouth end and a rod end open to the passage of air and smoke. The cigarette rod and the filter plug have substantially the same cross-sectional area and shape. A peripheral layer circumscribes the filter plug. Tipping paper circumscribes the filter plug and a portion of the cigarette rod adjacent the filter plug, and is adhered to the filter plug. First, second and third bands, in sequence, circumscribe the cigarette rod between the tipping paper and the cigarette rod adjacent the filter plug. The first band is adhered to the cigarette rod at a first preselected distance from the end of the cigarette rod adjacent the filter plug. The third band is adhered to the cigarette rod at a second preselected distance from that end of the cigarette rod. The second preselected distance exceeds the first preselected distance by an amount greater than the width of the second band. The second band is adhered to the tipping paper at a third preselected distance from the mouth end of the filter plug. The third preselected distance exceeds the sum of the length of the filter plug and the first preselected distance and also exceeds the sum of the length of the filter plug and the difference between the the second and first preselected distances. The filter plug is thereby movable longitudinally between a position in which the second band abuts the third band and a position in which the second band abuts the first band, lengthening or shortening the cigarette.

In a third embodiment, a cigarette comprises a substantially cylindrical cigarette rod having a mouth end and a coal end. A mouthpiece having a mouth end, a rod end and a mouthpiece length circumscribes the mouth end of the cigarette rod. A layer of tipping paper circumscribes the mouthpiece and a portion of the cigarette rod, and is adhered to the mouthpiece. First, second and third bands, in sequence, circumscribe the cigarette rod between the cigarette rod and the tipping paper layer. The first band is adhered to the cigarette rod at a first preselected distance from the mouth end of the cigarette rod. The third band is adhered to the cigarette rod at a second preselected distance from the mouth end of the cigarette rod. The second preselected distance exceeds the first preselected distance by at least the width of the second band. The second band is adhered to the tippinq paper layer at a third preselected distance from the mouth end of the mouthpiece. The third preselected distance is greater than the sum of the mouthpiece length and the first preselected distance and greater than the sum of the mouthpiece length and the difference between the second and first preselected distances. The tipping paper layer and the mouthpiece are movable longitudinally between a position in which the second band abuts the third band, and a position in which the second band abuts the first band.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

In the discussion that follows, when the distances of two bands from a particular point are compared, the distances are to be measured to the adjacent or abutting edges of the bands in question.

Figures 1, 1A:
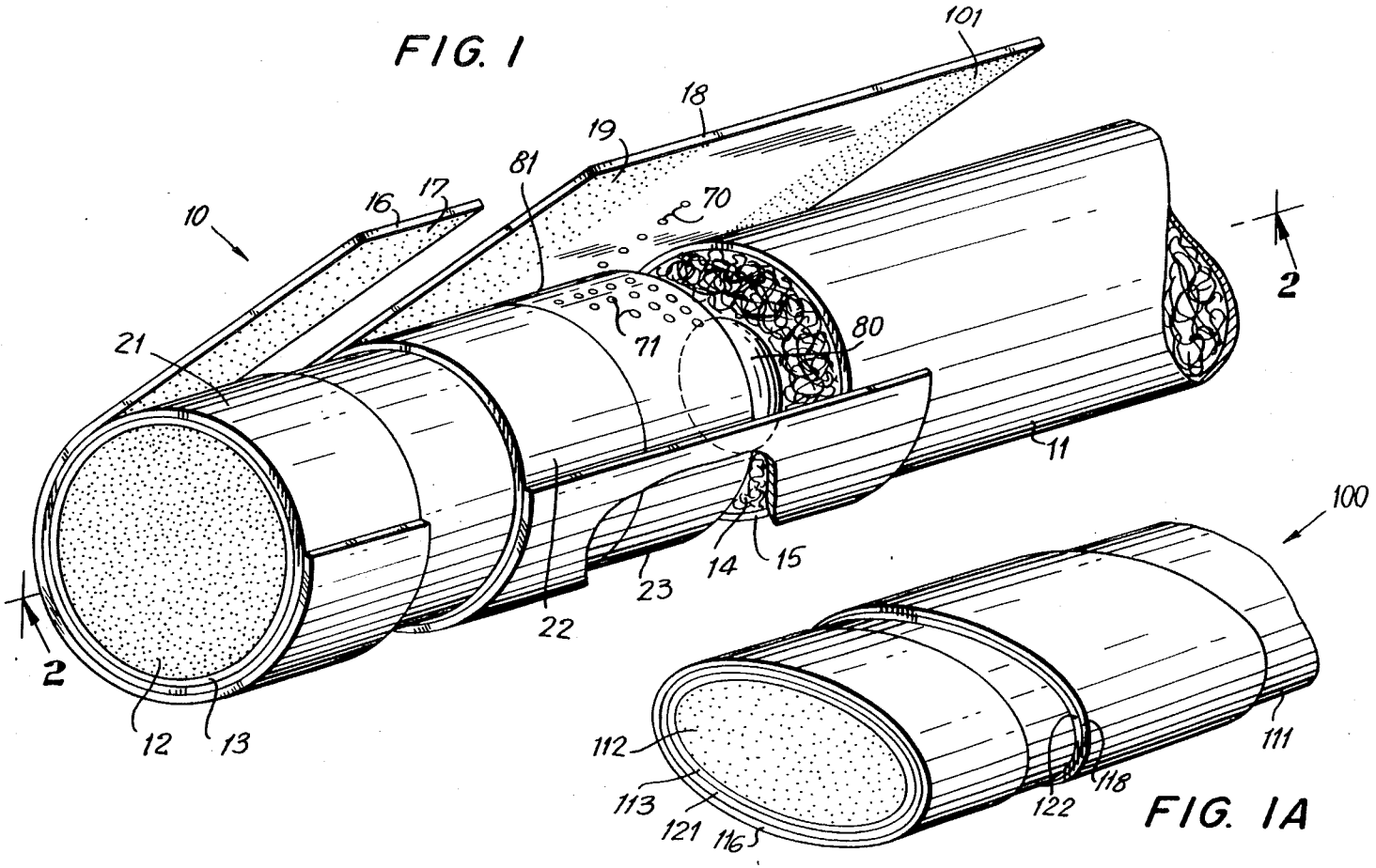
FIG. 1 is an exploded, partially fragmentary perspective view taken from the mouth end of a first embodiment of a cigarette according to the invention in its lengthened state.
FIG. 1A is a partially fragmentary perspective view taken from the mouth end of an ovoid embodiment of the cigarette of FIG. 1 in its lengthened state.
Figure 2:
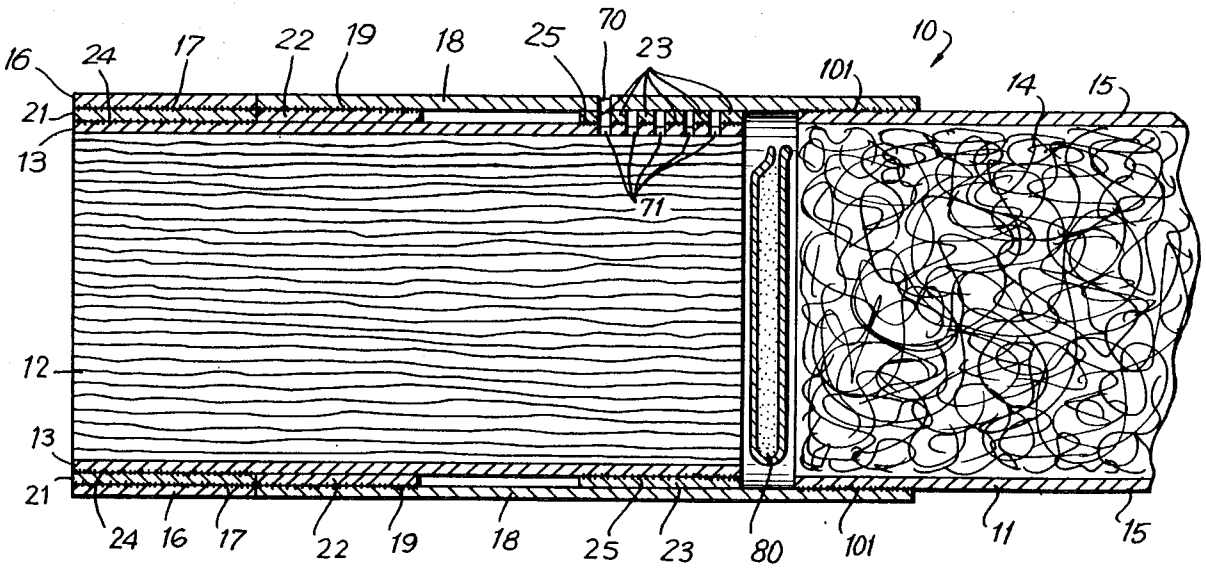
FIG. 2 is a fragmentary longitudinal cross-sectional view of the cigarette of FIG. 1 in its shortened state, taken from line 2—2 of FIG. 1.

A first embodiment 10 of a cigarette according to this invention is shown in FIGS. 1 and 2. Cigarette 10 includes a cigarette rod 11 and a filter plug 12 circumscribed by peripheral layer 13. Peripheral layer 13 could be traditional plug wrapping or an extruded covering, or it could be the outer self-supporting (e.g., fused) layer of an unwrapped filter plug. As shown, cigarette rod 11 is simply a tobacco rod, including a charge of tobacco 14 wrapped in cigarette paper 15. However, cigarette rod 11 could include an additional filter segment (not shown) at the end adjacent filter plug 12, so that the cigarette as a whole has a tobacco rod and a segmented filter plug. Filter plug 12 is circumscribed by three bands 21, 22, 23 of tipping paper or similar material, in sequence. First band 21 and third band 23 are adhered to peripheral layer 13 by adhesive bands 24, 25, respectively. The distance of first band 21 from the rod end of filter plug 12 exceeds the distance of third band 23 from the rod end of filter plug 12 by more than the width of second band 22. Second band 22 is not adhered to peripheral layer 13 and is thus free to slide along filter plug 12 between first and third bands 21, 22.

First band 21 is overwrapped by first tipping paper section 16, which is adhered to band 21 by adhesive band 17. Second tipping paper section 18 overlaps the remainder of filter plug 12 and a portion of cigarette rod 11, and is adhered to second band 22 by adhesive band 19 and to cigarette rod 11 by adhesive band 101. Adhesive band 19 is at least as far from the end of cigarette rod 11 adjacent filter plug 12 as first band 21 is from the rod end of filter plug 12.

Second tipping paper section 18 and second band 22 thus form a sleeve in which filter plug 12 can move longitudinally. First and third bands 21, 23 serve as stops to prevent plug 12 from moving too far in either direction. Third band 23 prevents the removal of plug 12 from cigarette 10, while first band 21 prevents plug 12 from moving too close to cigarette rod 11. As shown in FIGS. 1 and 2, first band 21 is positioned to stop plug 12 as it reaches cigarette rod 11, but it could be positioned to stop plug 12 at a finite distance from cigarette rod 11, if desired.

Figure 3:
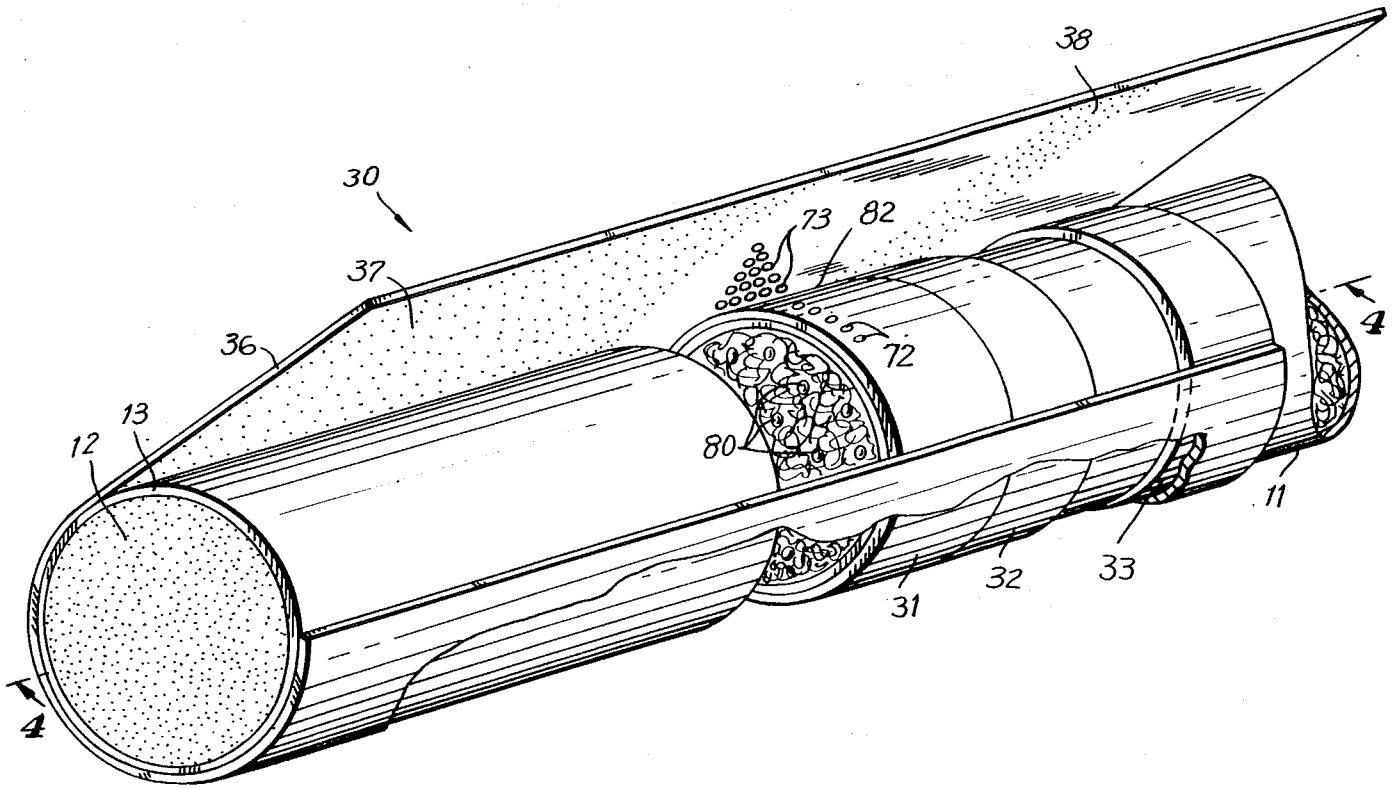
FIG. 3 is an exploded, partially fragmentary perspective view taken from the mouth end of a second embodiment of a cigarette according to the invention in its lengthened state.
Figure 4:
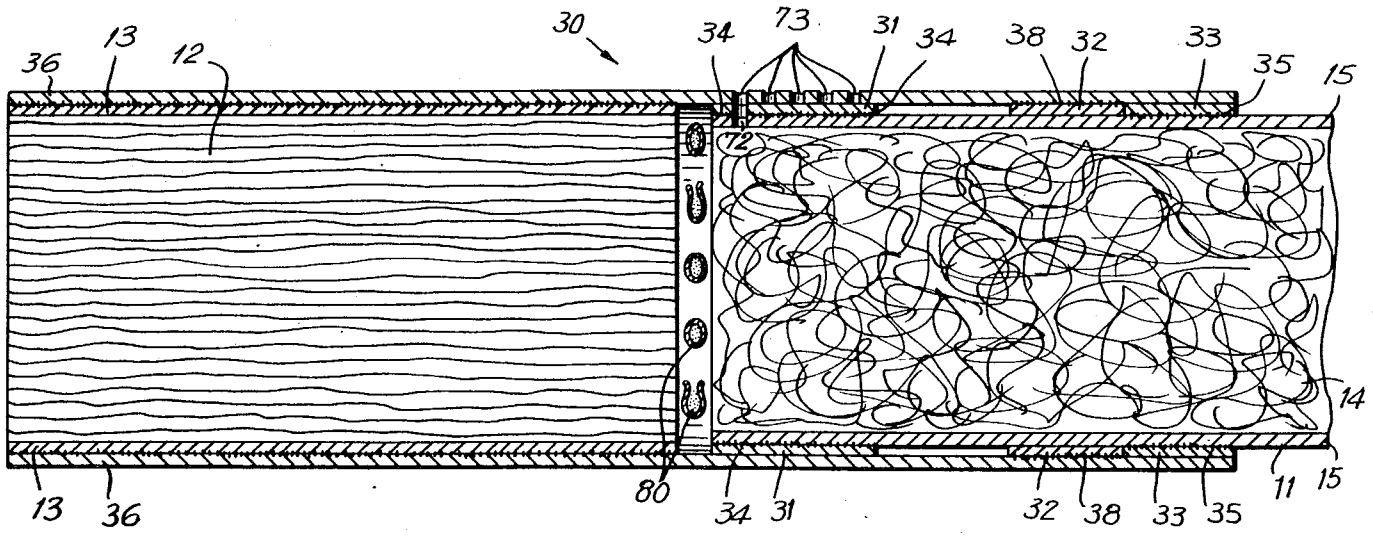
FIG. 4 is a fragmentary longitudinal cross-sectional view of the cigarette of FIG. 3 in its shortened state, taken from line 4—4 of FIG. 3.

A second embodiment 30 of a cigarette according to this invention is shown in FIGS. 3 and 4. Cigarette 30 also has a cigarette rod 11 and a filter plug 12 circumscribed by peripheral layer 13. Again, cigarette rod 11 is shown as being simply a tobacco rod, but could also include an additional filter segment. In this embodiment, cigarette rod 11 is circumscribed by first, second and third bands 31, 32, 33, in sequence. First and third bands 31, 33 are adhered to cigarette rod 11 by adhesive bands 34, 35 respectively. First band 31 is adhered to cigarette rod 11 at a first preselected distance from the end of cigarette rod 11 adjacent filter plug 12 and third band 33 is adhered to cigarette rod 11 at a second preselected distance from the end of cigarette rod 11 adjacent filter plug 12 which exceeds the first preselected distance by more than the width of second band 32. Second band 32 is not adhered to cigarette rod 11 and is thus free to slide along cigarette rod 11 between first and third bands 31, 33.

Filter plug 12 and first, second and third bands 31, 32, 33 are overwrapped by tipping paper 36, which is adhered to peripheral layer 13 by adhesive band 37 and to second band 32 by adhesive band 38. The distance from the mouth end of filter plug 12 to adhesive band 38 is greater than the sum of the length of filter plug 12 and the first preselected distance, and also greater than the sum of the length of filter plug 12 and the difference between the second and first preselected distances.

Tipping paper 36 and second band 32 thus form a sleeve with which filter plug 12 is longitudinally slidably mounted on cigarette rod 11. First and third bands 31, 33 serve as stops to prevent filter plug 12 from moving too far in either direction. First band 31 prevents the removal of filter plug 12 from cigarette rod 30. Third band 33 prevents filter plug 12 from moving too close to cigarette rod 11. As shown in FIGS. 3 and 4, third band 33 is positioned to stop filter plug 12 as it reaches cigarette rod 11, but it could be positioned to stop filter plug 12 at a finite distance from cigarette rod 11, if desired.

Figure 5:
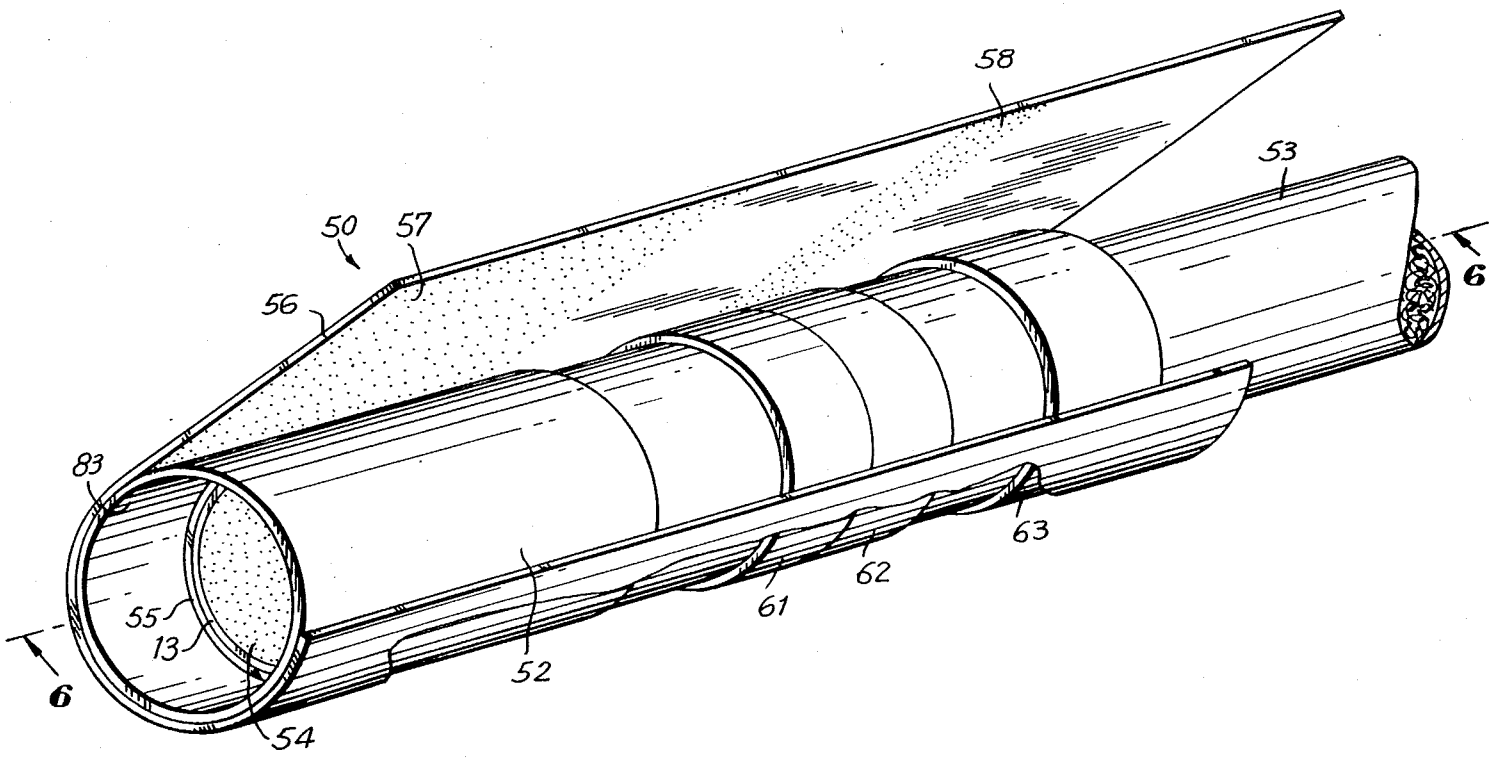
FIG. 5 is an exploded, partially fragmentary, perspective view taken from the mouth end of a third embodiment of a cigarette according to the invention in its lengthened state.
Figure 6:
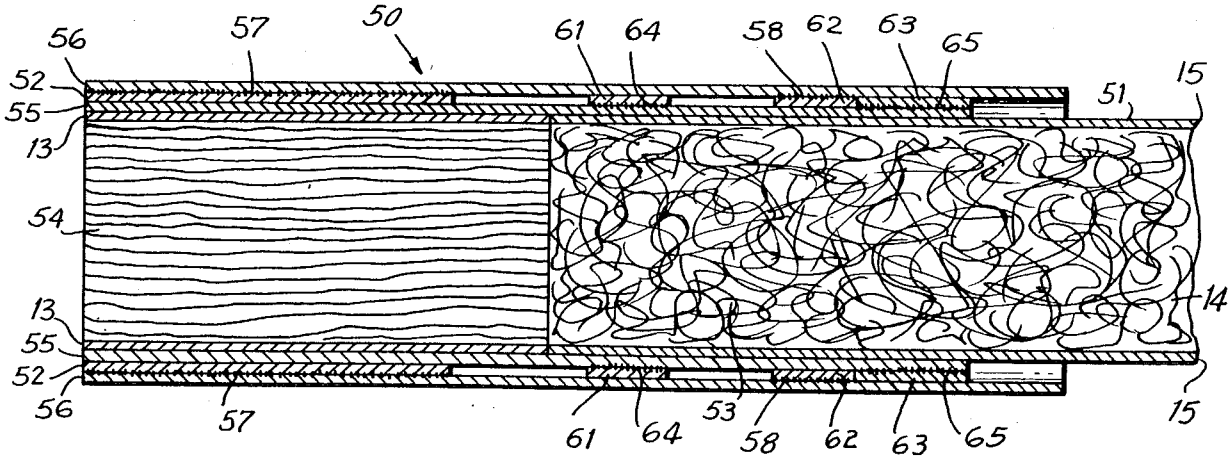
FIG. 6 is a fragmentary longitudinal cros-ssectional view of the cigarette of FIG. 5 in its shortened state, taken from line 6—6 of FIG. 5.

A third embodiment 50 of a cigarette according to this invention is shown in FIGS. 5 and 6. Cigarette 50 has a cigarette rod 51 circumscribed at its mouth end by a mouthpiece 52 of plastic or relatively stiff paper. As shown, cigarette rod 51 is shown as a tobacco rod 53 and a filter segment 54, joined together by tipping paper 55, but it can also be simply a tobacco rod. In this embodiment, cigarette rod 51 is circumscribed by first, second and third bands 61, 62, 63, in sequence. First and third bands 61, 63 are adhered to cigarette rod 51 by adhesive bands 64, 65, respectively. First band 61 is adhered to cigarette rod 51 at a first preselected distance from the mouth end of cigarette rod 51, and third band 63 is adhered to cigarette rod 51 at a second preselected distance from the mouth end of cigarette rod 51 which exceeds the first preselected distance by more than the width of second band 62. Second band 62 is not adhered to cigarette rod 51 and is thus free to slide along cigarette rod 51 between first and third bands 61, 63.

Mouthpiece 52 and first, second and third bands 61, 62, 63 are overwrapped by tipping paper 56, which is adhered to mouthpiece 52 by adhesive band 57 and to second band 62 by adhesive band 58. The distance from the mouth end of mouthpiece 52 to adhesive band 58 is greater than the first preselected distance and greater than the sum of the length of mouthpiece 52 and the difference between the second and first preselected distances.

Tipping paper 56 and second band 62 thus form a sleeve with which mouthpiece 52 is longitudinally slidably mounted on cigarette rod 51. First and third bands 61, 63 serve as stops to prevent mouthpiece 52 from moving too far in either direction. First band 61 prevents the removal of mouthpiece 52 from cigarette rod 51. Third band 63 prevents mouthpiece 52 from moving too far toward the coal end of cigarette rod 51. As shown in FIGS. 5 and 6, third band 63 is positioned to stop mouthpiece 52 when it is flush with the mouth end of cigarette rod 51, but it could be positioned to stop mouthpiece 52 before it is flush with rod 51, leaving some minimum recess.

Cigarettes 10, 30, 50 have all been shown with circular cross sections. It is within the scope of this invention to produce a variable length cigarette having an ovoid or other non-circular cross section. In FIG. 1A, cigarette 100 is shown having an ovoid cross section. Cigarette 100 is similar to cigarette 10 except for its cross-sectional shape, having an ovoid cigarette rod 111, and an ovoid filter plug 112 circumscribed by peripheral layer 113, first and second bands 121, 122, third band 123 (not shown), and first and second tipping paper sections 116, 118, all adhered as in cigarette 10.

The extendable portions of cigarettes according to this invention having circular cross sections can also be rotated. The extendable portions of cigarettes according to this invention having ovoid or other non-circular cross sections may or may not be rotatable. If they are constructed like cigarettes 10, 20 or 100, they cannot be rotated because the tipping paper sleeve is fixed in shape by being adhered to the filter plug. However, if they are constructed like cigarette 30, they may be rotatable if mouthpiece 52 is sufficiently deformable to follow the changing contours as the extendable portion is rotated.

In addition to providing variable length, the extendable portion of a cigarette according to this invention can also provide variable dilution or variable flavorant.

Variable dilution is shown in cigarettes 10, 30, and it can also be provided in cigarette 50. As seen in FIGS. 1 and 2, second tipping paper section 18 has a circumferential row of holes 70 overlying third band 23. Third band 23 and the underlying peripheral layer 13 have an array 71 of holes underlying row 70. Each row in array 71 has a different number of holes. Row 70 has the same number of holes as the row in array 71 with the greatest number of holes. As shown in FIG. 1, when the cigarette is at its maximum extended length, row 70 is in registry with the maximum row of array 71 providing maximum dilution by allowing a maximum amount of air to enter the smoke stream of cigarette 10. As shown in FIG. 2, cigarette 10 is at its minimum length and row 70 is in registry with the minimum row of array 71, providing minimum dilution. In this embodiment, array 71 is movable and row 70 is stationary, but the reverse is also possible.

As shown in FIGS. 3 and 4, cigarette 30 has a row 72 of holes in first band 31 and the underlying cigarette paper 15, and an array 73 of holes in tipping paper 36. In this embodiment, maximum dilution is provided with cigarette 30 at its minimum length, and minimum dilution is provided with cigarette 30 at its maximum length. Here too, the row of holes is shown as stationary, and the array of holes is shown as movable, but the reverse is also possible.

Other methods of dilution are possible in the construction shown in cigarette 10. Peripheral layer 13 can be made air-permeable. In such a case, as cigarette 10 is lengthened, more of permeable peripheral layer 13 is exposed to the air, increasing dilution. Another method that could be used is to provide two longitudinally elongated slits, one in the tipping paper and one in the peripheral layer, which register in varying degrees as the cigarette is lengthened and shortened. In any embodiment, at least one of the tipping paper and peripheral layer must be substantially air-impermeable for effective control of dilution.

No dilution mechanism is shown for cigarette 50, but it is possible to provide one.

If a particular embodiment is capable of rotation as well as extension, as discussed above, the dilution holes can be registered and deregistered by rotation as well as by extension.

Variable flavorant is shown in cigarettes 10, 30, and can also be provided in cigarette 50. As shown in FIGS. 1 and 3, cigarettes 10, 30 have crushable capsules 80 of flavorant between movable filter plug 12 and the end of cigarette rod 11. As filter plug 12 is moved forward on cigarette rod 11, capsules 80 are burst, releasing their flavorant. As an alternative, microcapsules (not shown) can be coated onto surfaces that move relative to adjacent surfaces, such as the inside of tipping paper 18 at 81, the inside of tipping paper 36 at 82, or the inside of mouthpiece 52 at 83. As these sections move relative to adjacent structures, the microcapsules are ruptured by friction. Other flavor trapping media can also be used.

When a single large capsule is used, as in FIG. 1, it is relatively easy to burst, and all the flavorant is released at once. The burst capsule is shown in FIG. 2. When several smaller capsules are used, as in FIG. 3, they are harder to break and do not all break at once, allowing the smoker to release additional flavorant by applying additional pressure. As shown in FIG. 4, only some of the capsules have been burst. When microcapsules are used, they are even harder to break, and more flavorant is released with each extension or shortening of the cigarette, as more capsules rupture because of friction.

As an alternative to capsules or microcapsules, a flavorant can be mixed with a carrier that will release it on contact with water vapor or other smoke constituents. The mixture can be coated onto surfaces that are exposed in varying amounts to the smoke flow as the cigarette is lengthened and shortened.

Many different flavorants can be used. Flavorants which can be added to the smoke during the course of smoking the entire cigarette, such as menthol, can be used. Alternatively, flavorants which would be overwhelming if added during the course of smoking the entire cigarette, but which would be refreshing and effective as a "last puff freshener" if added during the last few puffs, such as anise or orange, could be used. If a "last puff freshener" is used, the smoker would be instructed not to lengthen or shorten the cigarette until he was almost ready to finish it.

A preferred flavor capsule for use in the cigarette of the present invention has a shell of 80% vinyl acetate and 20% algin and is filled with menthol in peppermint oil. The fill makes up 70% of the capsule weight. The capsule diameter is from about 1,100 microns to about 2,500 microns. The capsule has an average break force of 272 grams.

Other capsules which can be used with this invention can have shells of paraffin or polyvinyl acetate with polyvinyl alcohol and can be filled with compounded flavors in coconut oil. The fill can make up 20–80% of the capsule weight, and the capsule diameter can be from about 800 microns to about 2,600 microns. The break force can range from about 60 grams to about 600 grams. Other types of capsules will be apparent to one skilled in the art.

Thus a cigarette is provided having a variable length which can also be provided with variable dilution and variable flavorant. One skilled in the art will appreciate that the present invention can be practiced by other than the described embodiments, which are presented for purposes of illustration and not of limitation, and the present invention is limited only by the claims which follow.

What is claimed is:

1. A filter cigarette comprising:

a substantially cylindrical tobacco rod;

a substantially cylindrical filter plug, the tobacco rod and the filter plug having substantially the same cross-sectional area and shape;

tipping paper circumscribing said filter plug and a portion of said tobacco rod;

means associated with said filter plug for lengthening and shortening said cigarette, said lengthening and shortening means being such as to retain said filter plug against removal from said cigarette; and means for varying the air dilution value of said filter cigarette responsive of lengthening and shortening of said filter cigarette.

2. The filter cigarette of claim 1 wherein the tobacco rod and the filter plug each have a circular cross section.

3. The filter cigarette of claim 1 wherein the tobacco rod and the filter plug each have an ovoid cross section and the cross sections are in registry.

4. A filter cigarette comprising:

a substantially cylindrical tobacco rod;

a substantially cylindrical filter plug, the tobacco rod and the filter plug having substantially the same cross-sectional area and shape;

tipping paper circumscribing said filter plug and a portion of said tobacco rod;

means associated with said filter plug for lengthening and shortening said cigarette, said lengthening and shortening means being such as to retain said filter plug against removal from said cigarette; and flavorant generating means associated with said filter plug and adapted to release varying amounts of flavorant responsive to lengthening and shortening of said filter cigarette.

5. The cigarette of claim 4 wherein the tobacco rod and the filter plug each have a circular cross section.

6. The cigarette of claim 4 wherein the tobacco rod and the filter plug each have an oval cross section and the cross sections are in registry.

7. A filter cigarette comprising:

a substantially cylindrical cigarette rod;

a substantially cylindrical filter plug having a length and having a mouth end and a rod end open to the passage of air and smoke, the cigarette rod and the filter plug having substantially the same cross-sectional area and shape;

a peripheral layer circumscribing said filter plug;

a first section of tipping paper circumscribing said filter plug adjacent the mouth end thereof;

a second section of tipping paper circumscribing a portion of said filter plug adjacent the rod end thereof and a portion of said cigarette rod adjacent said filter plug, and being adhered to said portion of said cigarette rod; and first, second and third bands having respective widths an circumscribing said filter plug in sequence between said peripheral layer and tipping paper, said first band adhered to said peripheral layer at a first preselected distance from said rod end of said filter plug and to said first section of tipping paper, said third band adhered solely to said peripheral layer at a second preselected distance from said rod end of said filter plug, said first preselected distance exceeding said second preselected distance by an amount greater than the width of said second band, and said second band adhered solely to said second tipping paper section at a third preselected distance from the end of said cigarette rod adjacent said filter plug, said third preselected distance being at least equal to said first preselected distance, whereby said filter plug is movable longitudinally between a position in which said second band abuts said third band and a position in which said second band abuts said first band, thereby lengthening and shortening said filter cigarette.

8. The filter cigarette of claim 7 wherein the cigarette rod and the filter plug each have a circular cross section.

9. The filter cigarette of claim 7 wherein the cigarette rod and the filter plug each have an ovoid cross section and the cross sections are in registry.

10. The filter cigarette of claim 7 further comprising means for varying the air dilution value of said filter cigarette responsive to lengthening and shortening of said filter cigarette.

11. The filter cigarette of claim 10 wherein said means for varying the air dilution value comprises a first opening in said peripheral layer and a second opening in said tipping paper, at least one of said tipping paper and said peripheral layer being substantialy air-impermeable, wherein longitudinal motion of said filter plug varies the registry between said first and second openings, thereby varying the amount of air admitted to said filter plug.

12. The filter cigarette of claim 7 further comprising flavorant generating means associated with said filter plug and adapted to release varying amounts of flavorant responsive to lengthening and shortening of said filter cigarette.

13. The filter cigarette of claim 12 wherein said flavorant generating means is an encapsulated flavorant positioned between the rod end of said filter plug and said cigarette rod, said flavorant being released by pressure of said filter plug against said encapsulated flavorant when said filter plug is moved toward said cigarette rod.

14. The filter cigarette of claim 12 wherein said flavorant generating means is an encapsulated flavorant positioned between said peripheral layer and said tipping paper, said flavorant being released by friction as said filter plug is moved toward and away from said cigarette rod.

15. The filter cigarette of claim 7 wherein said cigarette rod is a tobacco rod.

16. The filter cigarette of claim 7 wherein said cigarette rod comprises a tobacco rod and a filter segment at an end of said tobacco rod adjacent said filter plug.

17. A filter cigarette comprising:

a substantially cylindrical cigarette rod;

a substantially cylindrical filter plug having a mouth end and a rod end open to the passage of air and smoke, the cigarette rod and the filter plug having substantially the same cross-sectional area and shape;

a peripheral layer circumscribing said filter plug;

tipping paper circumscribing said filter plug and a portion of said cigarette rod, and being adhered to said filter plug; and first, second and third bands having respective widths and circumscribing said cigarette rod in sequence between said tipping paper and said cigarette rod adjacent said filter plug, said first band adhered to said cigarette rod at a first preselected distance from the end of said cigarette rod adjacent said filter plug, said third band adhered to said cigarette rod at a second preselected distance from said end of said cigarette rod, said second preselected distance exceeding said first preselected distance by an amount greater than the width of said second band, and said second band adhered to said tipping paper at a third preselected distance from said mouth end of said filter plug, said third preselected distance exceeding the sum of the length of said filter plug and said first preselected distance, and exceeding the sum of the length of said filter plug and the difference between said second and first preselected distances, whereby said filter plug is movable longitudinally between a position in which said second band abuts said third band and a position in which said second band abuts said first band, thereby lengthening and shortening said filter cigarette.

18. The filter cigarette of claim 17 wherein the cigarette rod and the filter plug each have a circular cross section.

19. The filter cigarette of claim 17 wherein the cigarette rod and the filter plug each have an ovoid cross section and the cross sections are in registry.

20. The filter cigarette of claim 17 further comprising means for varying the air dilution value of said filter cigarette responsive to lengthening and shortening of said filter cigarette.

21. The filter cigarette of claim 20 wherein said means for varying the air dilution value comprises a first opening in said tipping paper and a second opening in the surface of said cigarette rod, at least one of said tipping paper and said surface being substantially air-impermeable, whereby longitudinal motion of said filter plug varies the registry between said first and second openings, thereby varying the amount of air admitted to said filter cigarette.

22. The filter cigarette of claim 17 further comprising flavorant generating means associated with said filter plug and adapted to release varying amounts of flavorant responsive to lengthening and shortening of said filter cigarette.

23. The filter cigarette of claim 22 wherein said flavorant generating means is an encapsulated flavorant positioned between the rod end of said filter plug and said cigarette rod, said flavorant being released by pressure of said filter plug against said encapsulated flavorant when said filter plug is moved toward said cigarette rod.

24. The filter cigarette of claim 22 wherein said flavorant generating means is an encapsulated flavorant positioned between said cigarette rod and said tipping paper, said flavorant being released by friction as said filter plug is moved toward and away from said cigarette rod.

25. The filter cigarette of claim 17 wherein said cigarette rod is a tobacco rod.

26. The filter cigarette of claim 17 wherein said cigarette rod comprises a tobacco rod and a filter segment at an end of said tobacco rod adjacent said filter plug.

27. The filter cigarette of claim 26 further comprising means for varying the air dilution value of said filter cigarette responsive to lengthening and shortening of said filter cigarette.

28. The filter cigarette of claim 27 wherein said means for varying the air dilution value comprises a first opening in said tipping paper and a second opening in the surface of said cigarette rod overlying said filter segment, at least one of said tipping paper and said surface being substantially air-impermeable, whereby longitudinal motion of said filter plug varies the registry between said first and second openings, thereby varying the amount of air admitted to said filter cigarette.

29. A cigarette comprising:

a substantially cylindrical cigarette rod, having a mouth end and a coal end;

a mouthpiece having a mouth end, a rod end, and a mouthpiece length circumscribing the mouth end of said cigarette rod;

a layer of tipping paper circumscribing said mouthpiece and a portion of said cigarette rod, said layer being adhered to said mouthpiece; and first, second and third bands having respective widths circumscribing said cigarette rod in sequence between said cigarette rod and said layer, said first band adhered to said cigarette rod at a first preselected distance from said mouth end of said cigarette rod, said third band being adhered to said cigarette rod at a second preselected distance from said mouth end of said cigarette rod, said second preselected distance exceeding said first preselected distance by at least the width of said second band and by at most said mouthpiece length, and said second band being adhered to said layer at a third preselected distance from the mouth end of said mouthpiece, said third preselected distance exceeding the sum of said mouthpiece length and said first preselected distance, and exceeding the sum of said mouthpiece length and the difference between said second and first preselected distances, whereby said layer and said mouthpiece are movable longitudinally between a first position in which said second band abuts said first band, and a second position in which said second band abuts said third band.

30. The cigarette of claim 29 wherein the cigarette rod and the mouthpiece eaoh have a circular cross section.

31. The cigarette of claim 29 wherein the cigarette rod and the mouthpiece each have an ovoid cross section and the cross sections are in registry.

32. The cigarette of claim 29 wherein said cigarette rod is a tobacco rod.

33. The cigarette of claim 29 wherein said cigarette rod comprises a tobacco rod and a filter segment at an end of said tobacco rod remote from said coal end.

34. The cigarette of claim 29 further comprising means for varying the air dilution value of said cigarette responsive to lengthening and shortening of said cigarette.

35. The cigarette of claim 29 further comprising flavorant generating means adapted to release varying amounts of flavorant responsive to lengthening and shortening of said cigarette.

* * * * *

UNITED STATES PATENT AND TRADEMARK OFFICE

CERTIFICATE OF CORRECTION

PATENT NO. : 4,687,008

DATED : August 18, 1987

INVENTOR(S) : Willie G. Houck, Jr. et al.

It is certified that error appears in the above-identified patent and that said Letters Patent is hereby corrected as shown below:

Column 1 line 64, "is" should be -- its --.

Column 2, line 63, "tipping" should be -- tipping --.

Column 3, line 34, "cros-ssectional" should be -- cross-sectional --.

Claim 7, line 17, "an" should be -- and --.

Claim 30, line 2, "eaoh" should be -- each --.

Signed and Sealed this

First Day of March, 1988

*Attest:*

*Attesting Officer*

DONALD J. QUIGG

*Commissioner of Patents and Trademarks*